United States Patent [19]

Jackson et al.

[11] 4,249,636

[45] Feb. 10, 1981

[54] WORK TABLE OR PORTABLE SCAFFOLD

[76] Inventors: Charles A. Jackson, Rte. 2, Box 442, Hillsboro, Tex. 76645; Ray A. Ecklund, 2532 Oakwood Ter., Fort Worth, Tex. 76117

[21] Appl. No.: 17,928

[22] Filed: Mar. 6, 1979

[51] Int. Cl.[3] ..... E04G 1/34; E04G 1/28

[52] U.S. Cl. ..... 182/152; 182/225; 108/120

[58] Field of Search ..... 182/153, 154, 152, 225; 108/117, 119, 120, 124

[56] References Cited

U.S. PATENT DOCUMENTS

| | | | |
|---|---|---|---|
| 1,276,848 | 8/1918 | Wise | 108/119 |
| 1,350,857 | 8/1920 | De Cano | 108/124 |
| 2,944,354 | 7/1960 | Sellon | 108/119 |
| 3,080,202 | 3/1963 | Franze | 108/119 |

*Primary Examiner*—Reinaldo P. Machado
*Attorney, Agent, or Firm*—Wofford, Fails & Zobal

[57] ABSTRACT

This invention discloses portable, collapsible scaffold that is characterized by a substantially planar top platform; a front U-shaped leg structure pivotally connected with the top platform and adapted to fold into a collapsed position that is substantially parallel with and close to the platform; a diagonally extending leg structure pivotally connected with the respective front legs near their top and adapted to fold into a collapsed position; collapsible braces connected near the midpoint to the front legs and the diagonal legs; upper rear U-shaped leg structure that is movable along the bottom of the top platform and adapted to fold into a collapsed position; elongate bracket retaining the rear cross member in close proximity to the platform; and a lock for locking the rear cross member in the supporting position and adapted to prevent collapse of the scaffold until the platform is liftable to release the lock. The respective leg structures are adapted to unfold into a supporting position.

5 Claims, 6 Drawing Figures

WORK TABLE OR PORTABLE SCAFFOLD

BACKGROUND OF THE INVENTION

1. Field of the Invention

This invention relates to a folding scaffold.

2. Description of the Prior Art

A wide variety of different types of scaffolding has been known in the prior art. One of the increasingly urgent needs of the modern society is to have a portable scaffold that is readily carriable within doorways and the like; yet that can be readily erected by a single workman without requiring a long time and tools for assembly.

A search of the prior art shows many structures. In pertinent art is included patents such as the following: U.S. Pat. No. 1,566,171 shows a scaffold horse that is put together, as on the outside of a building or the like, for holding a board for bricklayers or the like; U.S. Pat. No. 1,749,706 shows a leg for a saw horse or the like; U.S. Pat. No. 2,526,666 shows an adjustable support structure; although specifically indicated to be a lap board, table, chair or the like; U.S. Pat. No. 2,272,957 shows a scaffolding in which the end supports are designed to lean against a building or the like and are otherwise unstable; 3,150,741 shows folding scaffolding with extensible legs or the like that can be assembled and disassembled into multiple pieces. In the non-analogous art, there are U.S. Pat. Nos. such as those to ironing tables, like 1,653,355 and 2,199,373; as well as adjustable stands, like 2,739,849. None of these are satisfactory, however, in supplying a stable platform that will support a man's weight as for interior finishing (taping, bedding and painting of sheetrock, for example), electric work, or the like; yet that can be carried by a single workman through openings like doorways.

SUMMARY OF THE INVENTION

Accordingly, it is an object of this invention to provide a readily portable, collapsible scaffold that can be carried by a single workman and emplaced readily without requiring tools or assembly of multiple parts.

It is also an object of this invention to provide a portable scaffold that meets the foregoing and that has unusually high structural strength, ease of access to the top platform and is economical and easily manufactured and delivered for sale.

These and other objects will become apparent from the descriptive matter hereinafter, particularly when taken in conjunction with the appended drawings.

In accordance with this invention, there is provided a portable, collapsible scaffold comprising: (a) a substantially planar top platform; (b) a front U-shaped leg structure including at least a pair of downwardly extending legs rigidly connected with a front cross member; the front cross member being pivotally connected with the top platform and adapted to fold into a collapsed position substantially parallel with the platform and to fold into a supporting position substantially perpendicular to the platform; (c) a diagonally extending leg structure including a pair of diagonally extending legs that are pivotally connected with respective front legs near their top close to the platform and adapted to fold into a collapsed position substantially parallel with the platform and the front legs and to fold into a supporting position extending diagonally downwardly and rearwardly to form the rear lower legs; (d) collapsible braces connected near the midpoint of the front legs and the diagonal legs; the collapsible braces being adapted to form triangle braces at their most elongate dimension in the supporting position and to fold into a collapsed position substantially parallel with and alongside the front and diagonal legs; (e) an upper rear U-shaped structure including a pair of downwardly extending rear legs rigidly connected with a rear cross member; the rear cross member being moveable along the bottom of the platform and the rear legs being pivotally connected with the diagonal legs below the midpoint thereof and above the bottom thereof such that the rear leg structure is adapted to fold into a collapsed position substantially parallel with the platform and the front and diagonal legs to form a compact, readily portable scaffold and to move into a support position substantially perpendicular to the platform; (f) elongate bracket to retain the rear cross member in close proximity to the top platform in both the collapsed and supporting positions; and (g) locking means for locking the rear cross member into the supporting position and adapted to prevent collapse of the scaffold until the platform is liftable to release the locking means. By "liftable" is meant that the workman and tools have been unloaded sufficiently that at least the elongate bracket and adjacent edge of the top can be raised, or lifted, to allow the rear cross member to move into the collapsed position.

In preferred embodiments, the front leg structure has connected therewith access means for facilitating climbing onto the top platform.

DESCRIPTION OF PREFERRED EMBODIMENTS

Figure 1:
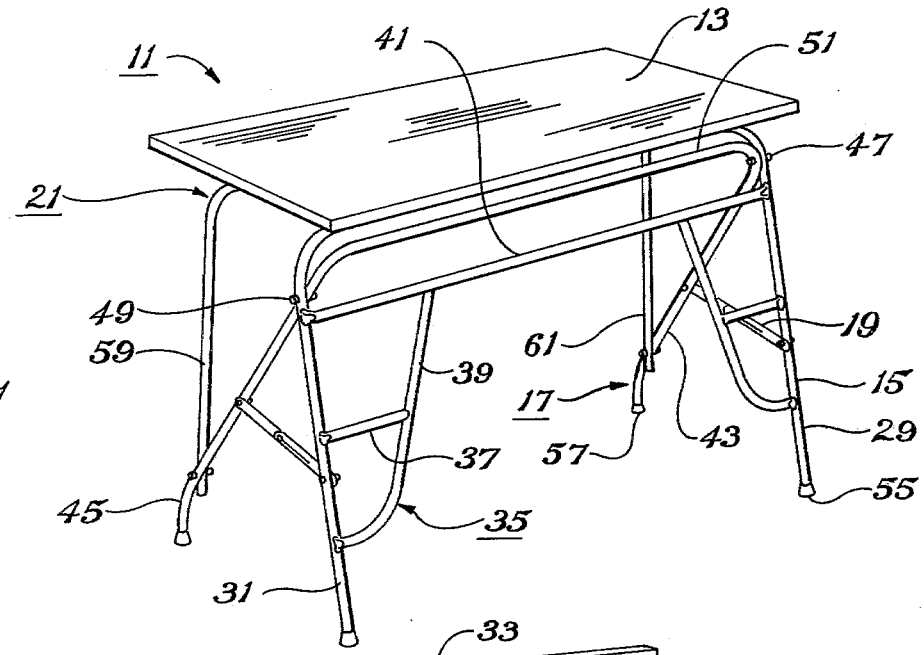
FIG. 1 is a perspective view of one embodiment of the portable scaffold of this invention in the supporting position.
Figure 2:
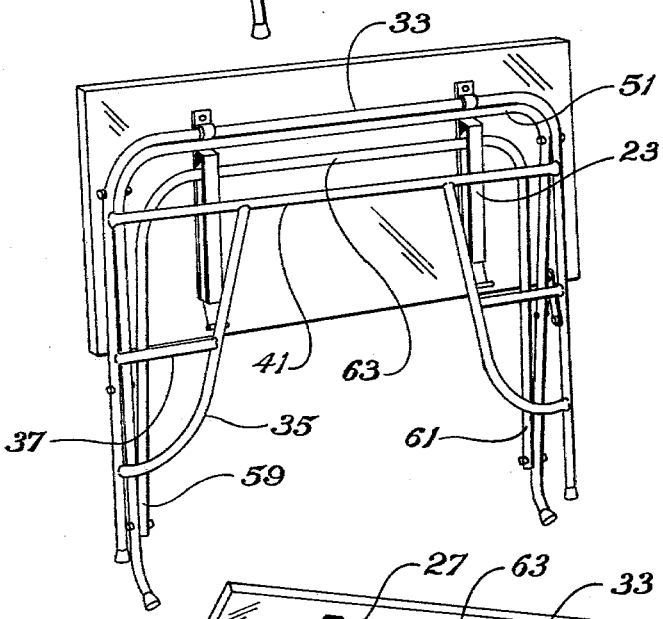
FIG. 2 is a perspective view of the embodiment of FIG. 1 folded into the collapsed position.
Figure 3:
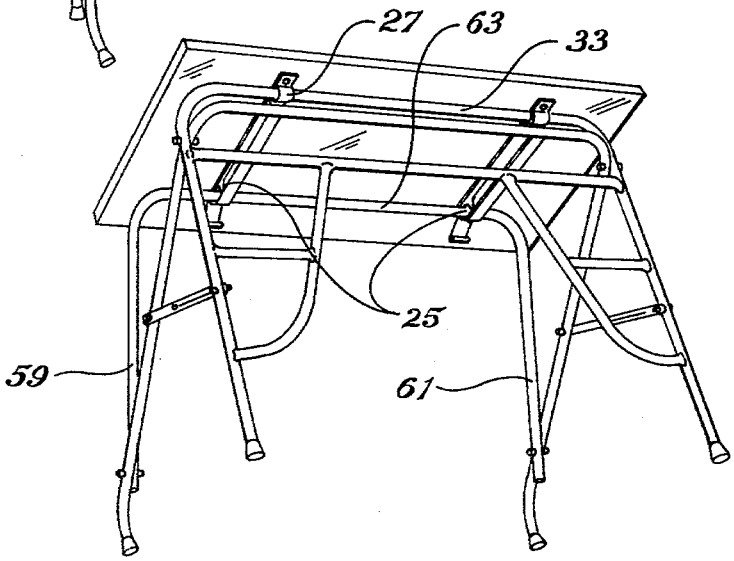
FIG. 3 is a bottom view of the embodiment of FIG. 1 showing the under structure of the brackets and lock means on the bottom of the top platform.
Figure 4:
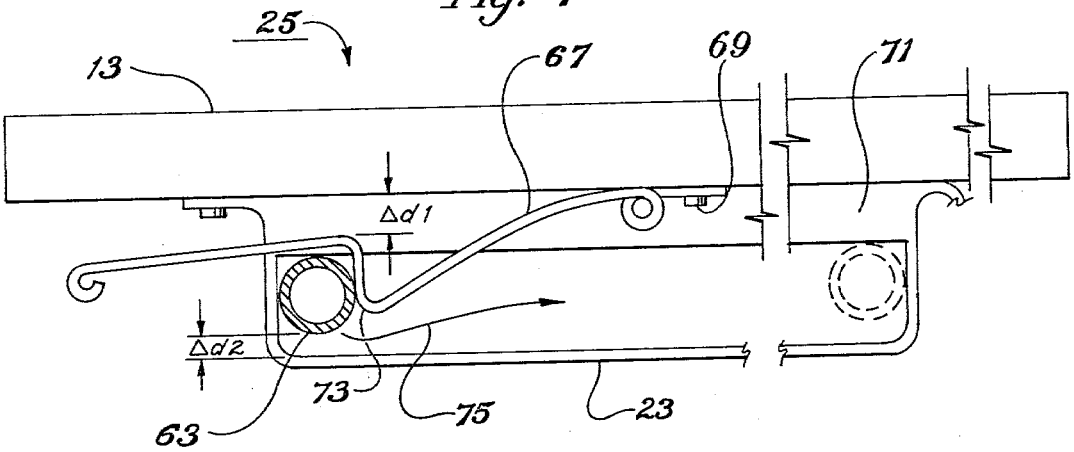
FIG. 4 is a partial schematic view of the locking means of the embodiment of FIG. 1.

Referring to FIG. 1, the portable, collapsible scaffold 11 comprises a substantially planar top platform 13, a front leg structure 15, diagonally extending leg structure 17, collapsible braces 19, rear leg structure 21, elongate bracket 23, FIG. 2, and locking means 25, FIGS. 3 and 4.

The substantially planar top platform 13 may comprise any of the available, substantially planar surfaces that are durable, wear resistant, and have the structural strength to support weight of a man and materials that the workman will use on top of the scaffold 11. Typical materials for the top platform comprise wood, metals such as aluminum or steel and honeycombed plastic with densified skin such as the Nu Core, polyurethane, polystyrene and the like. If desired, wear resistant covering, such as corundum, silicon carbide and the like, can be employed on the top. Also, the top platform 13 must be adaptable to hold in place the pivotal brackets by which the respective legs are mounted thereto, as well as the retaining brackets and the locking means for holding the rear leg structure. A multilayer plyboard, such as the 5/8 or ¾ inch plyboard will be economical and adequate. The honeycombed plastic with a suitable top surface may be employed for lighter weight to enable the workman to more easily carry the scaffold.

The front leg structure 15 is pivotally connected with the top platform 13 by way of suitable brackets 27, FIG. 3. The front leg structure 15 may take any of the conventional shapes. As illustrated, it is a U-shaped bent tubular leg structure that includes at least a pair of downwardly extending legs 29, 31 integrally formed with a front cross member 33, FIGS. 2 and 3. As can be seen more clearly in FIG. 3, the front cross member is pivotally connected with the platform by way of the pivotal mounting bracket, with or without a bushing, and adapted to fold into a collapsed position substantially parallel with the platform, as illustrated in FIG. 2. The front leg structure is also adapted to fold into a supporting position substantially perpendicular to the platform. By substantially perpendicular it is meant within an angle of 20° with respect to the vertical, or perpendicular plane. The front U-shaped leg structure may be made of any suitably strong material. For highest structural strength with lightest weight, it is preferred to employ a tubular structure such as of aluminum tubing or the like. If desired, of course, other strong tubing such as steel, magnesium, or the like can be employed.

As illustrated, the front leg structure also includes access means 35 facilitating access to the top platform 13. The illustrated access means comprises a ladder-like structure in which the ladder steps 37 are affixed, as by welding, silver soldering or bolting, to the front leg 31 and to a vertically extending member 39. The vertically extending members 39 are affixed, as by welding, silver soldering, bolting, or the like to the cross member 41. The respective connections of the cross member and the horizontal steps with the front leg structure 15 are arcuately outwardly adjusted so as to fold into a substantially planar structure encompassing the diagonal and rear legs between the access means 35 and the top platform 13 when folded into the collapsed position illustrated in FIG. 2.

In the illustrated embodiment, the ladder steps 37, the vertical members 39, and the horizontal cross members 41 are preferably formed of tubular material having adequate structure strength, such as, metals like aluminum, iron, magnesium.

The diagonally extending leg structure 17 includes a pair of diagonally extending legs 43, 45 that are pivotally connected with the front legs near their top, as at the points 47, 49. As illustrated, the diagonally extending legs are also rigidly connected with a horizontal cross member 51 for strength and rigidity. The diagonal legs are adapted to fold into a collapsed position substantially parallel with the platform and the front legs, as shown in FIG. 2. The diagonal legs are also adapted to fold into a supporting position extending diagonally downwardly and rearwardly to form the rear lower legs.

As illustrated, the front and rear lower legs have respective feet 55, 57 on their lower ends. Similarly as described hereinbefore with respect to the front leg structure, it is preferred that the diagonally extending leg structure be formed of metallic tubing such as aluminum for light weight, high strength structure. Of course, if desired, the tubular material may be of steel or magnesium or the like. Similarly, the cross sectional shape may be varied such as square tubing, I-beam structure, or the like, but these are usually more expensive and less readily worked with.

Figure 5:
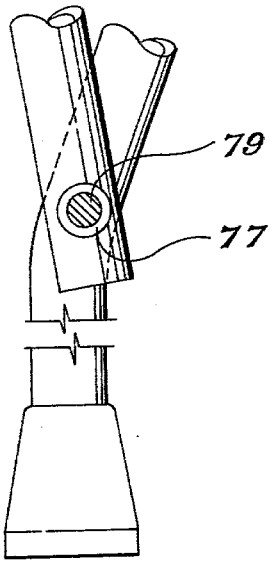
FIG. 5 is a partial side elevational view of the pivotal connection of a rear leg with a diagonal leg.
Figure 6:
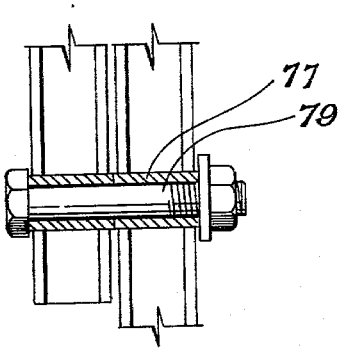
FIG. 6 is a partial cross sectional view of the joint of FIG. 5.

The front leg structure and the rear leg structure are pivotally connected to the diagonally extending leg structure by respective joints similar to that shown in FIGS. 5 and 6, although any pivotal joint may be adequate. The pivotal joint will be described in more detail hereinafter with respect to the joinder of the bottom of the rear leg structure with the diagonal leg structure. It is sufficient to note that any of the pivotal mountings of the prior art may be employed.

The diagonal leg structure and the front leg structure are connected together by collapsible braces 19 connected near the midpoint of the front legs and the diagonal legs. The collapsible braces 19 are adapted to form a triangle brace at their most elongate dimension in the supporting position, as illustrated in FIG. 1. The collapsible braces are also adapted to fold into a collapsed position substantially parallel with and alongside the front and diagonal legs. Each brace can have any suitable structure; such as, folding in the middle, pivotal connection, sliding connection, or a combination that will provide the rigid supporting scaffold, yet fold into a compact package.

Pivotally connected with the diagonal legs 43, 45 and forming an upper rear leg structure is the rear U-shaped leg structure 21. The upper rear U-shaped leg structure 21 includes a pair of downwardly extending rear legs 59, 61 that are rigidly connected with a rear cross member 63. The rear cross member 63 is moveable along the bottom of the top platform. The rear legs 59, 61 are pivotally connected with the diagonal legs below the midpoint thereof and above the bottom thereof such that the rear leg structure is adapted to fold into a collapsed position substantially parallel with the platform and with the front and diagonal legs to form a compact, readily portable scaffold. The rear leg structure 21 is also adapted to move into a supporting position substantially perpendicular to the platform 13. Similarly as described hereinbefore with respect to the front and diagonal legs, the rear legs are preferably formed of tubular metal such as steel or aluminum for light weight high strength. If desired, steel tubing or magnesium tubing may be employed. Moreover, other cross sectional shapes such as square tubing, I-beam construction or the like may be employed, although such structures are ordinarily more expensive and more difficult to work with.

The rear cross member is retained in close proximity to the top platform 13 in both the collapsed and supporting positions by means of a pair of brackets 23. As with the brackets on the front leg structure, the brackets 23 are disposed near each end of the platform 13. For example, they may be disposed about ¼ of the total length of the platform from each respective end up to as much as ⅓ of the total distance. Of course, other numbers of brackets could be employed if desired but two has been found to give adequate strength and rigidity. Preferably, the elongate brackets 21 are formed of light weight metal such as aluminum; although other materials such as plastic or other metals may be employed.

One of the main reasons for employing metal is to facilitate affixing the locking means 25. The locking means 25 comprises a locking member 67 that is biased downwardly by a suitable spring structure. As illustrated, the biased locking member 67 may be affixed, as by brads or the like to a structural member 71 which may be the same as or different from the bracket 23. It is noteworthy in the locking means that simply lifting up on the inclined end 73 will not free the cross member 63. Instead, the top 13 must be lifted sufficiently to clear the rear cross member 63. This requires the additional distance $\Delta d_2$ in addition to the distance $\Delta d_1$ that is available to be lifted by the inclined end 73. Expressed otherwise, the top platform 13 must be unloaded so as to be lifted the distance $\Delta d_2$ to allow the member 63 to move toward the collapsed position, shown by arrow 75. Similarly, the locking member is forced into position by sliding down the inclined end 73 and also forcing the top 13 to move upwardly the distance $\Delta d_2$ to move into the locked position.

The joint at which the rear legs are connected with the diagonal legs is illustrated in FIGS. 5 and 6 and may serve as a model also for the pivotal joints also at points 47 and 49. As illustrated, there is a bushing 77 about the bolt 79. The bushing 77 is preferably affixed, as by welding, to each of the respective legs and affords additional strength that resists tearing of the tubular legs because of the weight imposed on the bolt 79 at the respective joints.

In operation, the scaffold 11 is assembled as described hereinbefore. To be carried into the job, it is collapsed as shown by FIG. 2. The workman thereafter carries it into the room or the like in which it is to be employed. At the simple expedient of lifting the top and pulling the cross member 63 rearwardly, it is moved into the supporting position with the front and rear legs substantially perpendicular to the top platform 13. Thereafter, the workman may set his materials, tools and the like on the top surface 13 and clamber up the access means 35 to perform his task.

Once the task has been completed, the workman climbs off the top platform 13, removes the tools and materials, lifts up on the top 13 and the inclined end 73 for the distance $\Delta d_1$ plus $\Delta d_2$ to release the cross member 63. The cross member is then pulled into the collapsed position and all of the legs move into the collapsed position, as shown in FIG. 2. Thereafter, the workman can carry the scaffold to the new position and similarly erect it in this simple manner.

From the foregoing it can be seen that this invention achieves the objects delineated hereinbefore. Specifically, it provides a portable scaffold that is widely useful in a variety of different applications. For example, it can serve as a household step ladder, a portable scaffold for bricklayers, for workmen taping and bedding sheetrock, as a drafting table, as benches, as a projection table, as a work table, as a flush mounting structure for working on aircraft, as church benches, as catering tables and the like.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

We claim:

1. A portable, collapsible scaffold comprising:

a. a substantially planar top platform;

b. a front U-shaped leg structure including at least a pair of operationally downwardly extending legs rigidly connected with a front cross member; said front cross member being pivotally connected with said top platform adjacent a longitudinal edge thereof such that said front legs are adapted to fold laterally into a collapsed position substantially parallel with said platform and fold into a supporting position substantially perpendicular to said platform;

c. a diagonally extending leg structure including a pair of operationally diagonally extending legs that are pivotally connected with said front legs near their top close to and below said platform and adapted to fold laterally into a collapsed position substantially parallel with said platform and said front legs and to fold into a supporting position extending diagonally downwardly and rearwardly to form the rear lower legs;

d. collapsible braces connected near the midpoint of said front legs and said diagonal legs; said collapsible braces being adapted to form a triangle brace at their most elongate dimensions in said supporting position and to fold laterally into a collapsed position substantially parallel with and alongside said front and diagonal legs;

e. an upper rear U-shaped leg structure including a pair of operationally downwardly extending rear legs rigidly connected with a rear cross member; said rear cross member being movable along the bottom of said top platform and said rear legs being pivotally connected with said diagonal legs below the midpoint thereof and above the bottom thereof such that said rear leg structure is adapted to fold laterally into a collapsed position substantially parallel with said platform and said front and diagonal legs to form a compact, readily portable scaffold and to move into a supporting position substantially perpendicular to said platform;

f. elongate bracket containing said rear cross member in close proximity to said top platform in both said collapsed and supporting positions; and g. locking means for locking said rear cross member into said supporting position and adapted to prevent collapse of said scaffold until said platform is liftable to release said locking means.

2. The scaffold of claim 1 wherein said front legs have connected therewith access means for facilitating climbing onto said top platform.

3. The scaffold of claim 1 wherein said diagonal legs are rigidly connected with an intermediate cross member for additional rigidity and strength.

4. The scaffold of claim 1 wherein said front and diagonal legs have gripping feet on their bottom ends.

5. The scaffold of claim 1 wherein at least two said elongate bracket means are employed and said bracket means are connected with said top platform on the bottom thereof and toward each said end thereof and slidably contain said rear cross member; each said bracket having a locking means.

* * * * *